US005390708A

United States Patent [19]

Kuster et al.

[11] Patent Number: 5,390,708

[45] Date of Patent: Feb. 21, 1995

[54] APPARATUS FOR TRANSLATING YARNS IN THE PROPER POSITION AND ORIENTATION FOR FORMING A WOVEN JOIN

[75] Inventors: Heinz Kuster; Stephan Kuster, both of Sandpoint, Id.

[73] Assignee: Asten Group, Inc., Charleston, S.C.

[21] Appl. No.: 124,921

[22] Filed: Sep. 21, 1993

[51] Int. Cl.[6] ..... D03D 41/00; D03J 1/14

[52] U.S. Cl. ..... 139/383 AA; 28/141

[58] Field of Search ..... 139/383 AA, 302, 303, 139/116.2; 28/141

[56] References Cited

U.S. PATENT DOCUMENTS

| | | | |
|---|---|---|---|
| 4,410,015 | 10/1983 | Koller et al. . | |
| 4,557,025 | 12/1985 | Eglin . | |
| B1 4,581,794 | 1/1989 | Oldroyd et al. . | |
| 4,985,970 | 1/1991 | Krenkel et al. | 139/383 AA |
| 5,022,440 | 6/1991 | Velechovsky | 139/116.2 |
| 5,027,483 | 7/1991 | Anderson | 139/383 AA |
| 5,060,699 | 10/1991 | Velechovsky | 139/116.2 |
| 5,117,542 | 6/1992 | Krenkel et al. | 139/383 AA |
| 5,158,120 | 10/1992 | Kaufmann et al. | 139/116.2 |

*Primary Examiner*—Andrew M. Falik

*Attorney, Agent, or Firm*—Volpe and Koenig

[57] ABSTRACT

A yarn positioning apparatus for use in an automated seaming machine for forming a woven join between opposite ends of a length of woven fabric, of the type in which an auxiliary strip of threads are supported in parallel relation to the cross machine direction threads in the woven fabric. The opposite ends of the fabric are supported on opposite sides of the auxiliary threads and each end of the woven fabric includes a fringe of machine direction (MD) threads. The MD threads are successively separated from the fringe and interwoven with the auxiliary thread to form the join. The yarn positioning apparatus is comprised of a yarn gripper for gripping a previously woven yarn from a fabric fringe in a first orientation and repositioning it to a second orientation. The yarn is retained in its second orientation as it is translated for further processing.

5 Claims, 9 Drawing Sheets

APPARATUS FOR TRANSLATING YARNS IN THE PROPER POSITION AND ORIENTATION FOR FORMING A WOVEN JOIN

BACKGROUND OF THE INVENTION

1. Field Of The Invention

The present invention relates to an apparatus for positioning yarns. More particularly, the present invention relates to an apparatus for separating and gripping yarns from a fringe and positioning them for further processing. Most particularly, the present invention relates to an apparatus for separating previously woven yarns from a fringe and presenting them to an interlacer in an automated seaming machine which produces a woven join in industrial or papermaking fabrics.

2. Description of the Prior Art

The papermaking industry commonly employs large woven fabric belts made of flat woven fabrics whose ends have been joined together to render them endless. Traditionally, this joining was accomplished by a manual or semi-automated weaving process that was both time consuming and labor intensive. Recently, the advantages of utilizing automated equipment to weave the joins which render flat woven fabrics endless have been recognized in the art.

U.S. Pat. Nos. 4,581,794 and 5,027,483, which are commonly assigned with the present invention to Asten Group, Inc., provide an apparatus for forming a woven join or seam between opposite ends of a woven fabric and an apparatus for selectively releasing yarns from a fringe which is utilized in conjunction with the seaming apparatus. Automated seaming machinery utilizing the technology disclosed in these patents has performed satisfactorily. However, some areas of automated join formation still present problems.

Due to the configuration, memory and crimp of certain yarns (or threads) utilized in papermaking fabrics, the yarns from the ends of the woven fabric are sometimes woven or joined into the seam in an orientation which is different than the yarn's original woven orientation in the fabric body. This problem has been traced to the manner in which the prior apparatus grips the yarns or threads and translates them to the joining area. The prior art does not provide any means to insure the proper orientation of the yarns as they are translated to the joining area and interwoven to form the join. When a join yarn is not in its original woven fabric orientation, it causes an incongruity in the woven join area. This must be corrected by the operator through the process of unweaving and reweaving the join with the yarns placed in the proper orientation. This problem can be more acute when yarns with non-circular cross-sections are utilized.

SUMMARY OF THE INVENTION

The present invention provides a yarn positioning apparatus for use in an automated seaming machine. The yarn positioning apparatus is comprised of a means for gripping a previously woven yarn from a fabric fringe in a first orientation and repositioning it to a second orientation. The yarn is retained in its second orientation as it is translated for further processing. This device can be used to control the orientation of yarns being woven into a join.

The invention also provides a method for forming a join in a length of the woven fabric, comprised of interwoven machine direction and cross machine direction threads, to form an endless woven fabric belt. The following items are first provided; (1) an auxiliary strip of threads and a means for supporting them in parallel relation to the cross machine direction threads in the woven fabric; (2) a means for forming a shed opening in the auxiliary strip; (3) a means for supporting a fringe of machine direction threads on the opposite ends of the fabric on opposite sides of the auxiliary threads and for successively releasing and MD threads from the fringe; (4) means for gripping a successive MD thread in its original woven orientation, then twisting the gripped MD thread to a second orientation, and translating the gripped MD thread to the shed opening while retaining it in the second orientation; and (5) a means for gripping and pulling the successive MD thread through the shed opening to form the seam.

A successive MD thread is released from the fringe and gripped in its woven orientation by the gripping, twisting and translating means. The successive MD thread is then twisted to a second orientation. The means for forming a shed opening forms the shed opening in the auxiliary strip of threads, and the successive MD thread is then translated to the shed opening. The MD thread is then gripped by the means for pulling the thread through the shed opening before being released by the gripping, twisting and translating means. The successive MD thread is then pulled through the shed opening so that it is interwoven with the auxiliary strip in its original woven fabric orientation.

It is an object of this invention to provide a yarn positioning apparatus for use in an automated seaming machine which controls the orientation of the MD yarns (or threads) as they are separated from the fringe and translated for further processing such that they are interwoven in the seam in their original woven fabric orientation.

It is an object of this invention to provide a method for forming a seam in a length of woven fabric to render the fabric endless whereby the MD yarns (or threads) are woven into the seam in their woven fabric orientation.

DESCRIPTION OF THE PREFERRED EMBODIMENT

Most woven fabrics which require joining or reweaving to form an endless belt are flat woven; however, it is possible that a continuously woven fabric could be cut and require joining. To eliminate any confusion which might arise with respect to warp and weft yarns or threads in flat woven or continuously woven fabrics, the invention will be disclosed with general reference to machine direction (MD) and cross-machine direction (CMD) threads.

The present invention is used in conjunction with the automated seaming machine described in U.S. Pat. No. 4,581,794 which is incorporated herein as if fully set forth.

Figure 1:
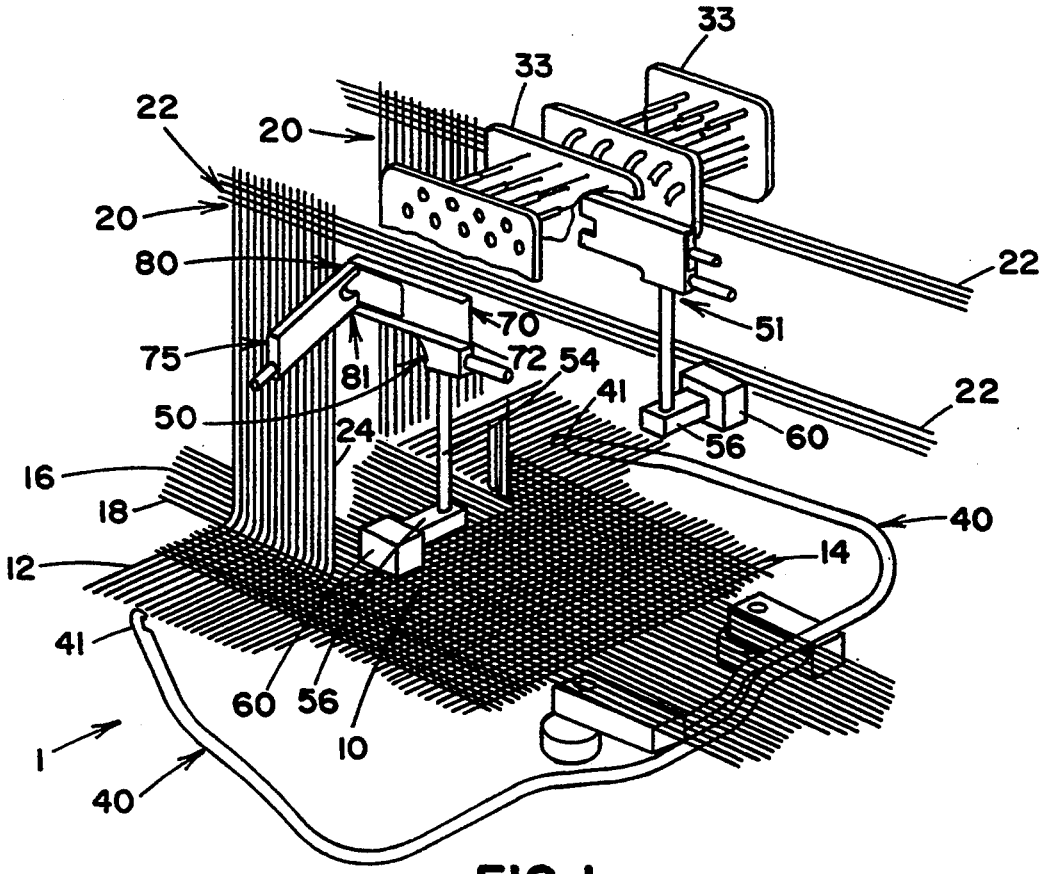
FIG. 1 is a perspective illustration of a seaming machine join area including a yarn gripper-transfer arm in accordance with the present invention.

FIG. 1 shows a seaming machine 1 for forming a join 10 between the opposite ends 12 and 14 of a length of woven fabric. A strip of auxiliary threads 16, parallel to the CMD threads, is supported between the ends of the woven fabric. The opposite ends 12 and 14 of the woven fabric each include a fringe 20 formed by removing a majority of the CMD threads from the MD threads. A narrow ribbon of CMD fringe threads 22 is left at the edge of the fringe 20 to maintain the MD threads 24 in their proper alignment and orientation with respect to the woven fabric. Each ribbon of CMD fringe threads 22 is supported by suitable means, not shown, such that the MD threads 24 forming the fringe 20 are generally normal to the auxiliary strip 16. Means for forming a shed opening 33 in the ribbon of CMD fringe threads 22 are attached to the ribbon 22. A suitable shed forming device is described in U.S. Pat. No. 5,027,483, which is incorporated herein as if fully set forth. This will all be known to those skilled in the art.

Gripper-transfer arm assemblies 50 and 51 in accordance with the present invention are positioned to rotate between each respective fringe 20 and the strip of auxiliary CMD threads 16. Interlacing arms 40, of the type disclosed in U.S. Pat. No. 4,581,794, are positioned below the fabric ends 12 and 14. The interlacing arms 40 move across the width of the strip of auxiliary CMD threads 16.

The gripper-transfer arm assemblies 50 and 51, and their use in the seaming apparatus 1 provide a preferred embodiment of the present invention. A general description of the structure and function of the gripper-transfer arm assemblies 50 and 51 will be given with respect to the left-hand arm assembly 50. A detailed description of the arm assembly 50 and its operation will follow.

Figure 2:
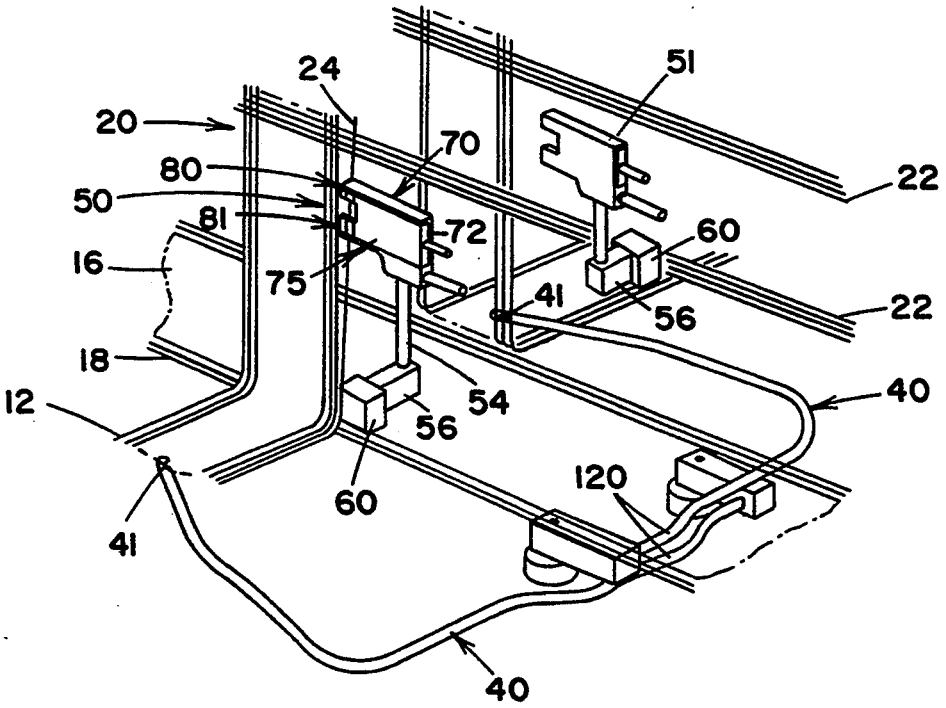
FIG. 2 is a perspective illustration similar to FIG. 1, showing a gripper-transfer arm after it separated a thread from the fringe.
Figure 3:
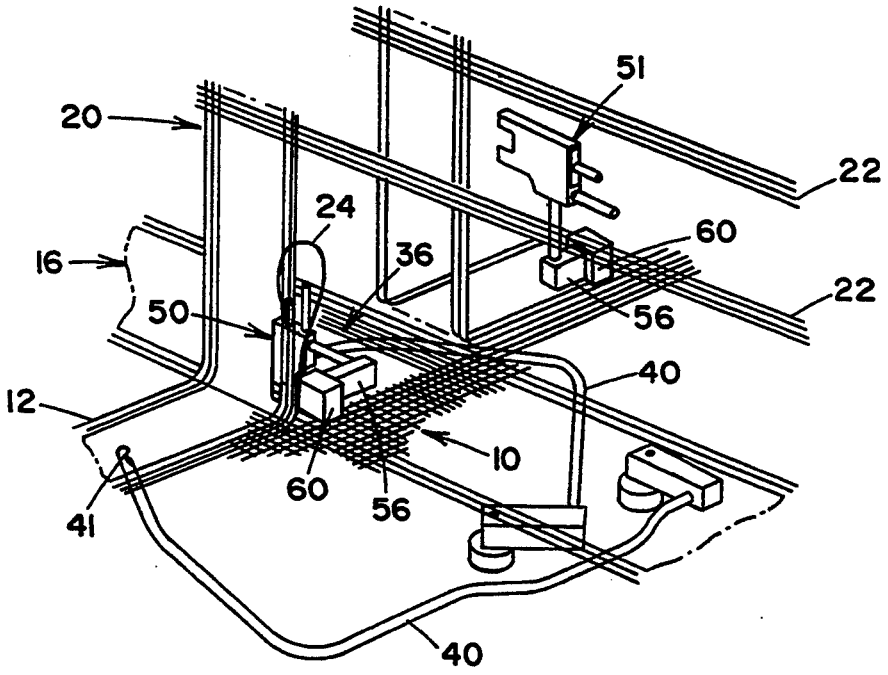
FIG. 3 shows the gripper-transfer arm transferring the separated MD thread to an interlacing arm.

FIGS. 1–4 illustrate the sequential actions of the left hand gripper-transfer arm assembly 50 as it removes an MD thread 24 from the fringe 20 and presents it to an interlacing arm 40 for interweaving with the auxiliary threads 16. The gripper-transfer arm assembly 50 is shown in the gripping position in FIG. 1. The assembly 50 is comprised of a twin-gripper assembly 70 which is connected to a base 56 by an arm 54. The twin-gripper assembly 70 includes a fixed housing 72 and a pivoting twin-gripper body 75. In the initial gripping position, the twin-gripper body 75 is pivoted away from the fixed housing 72 to a position generally normal to the fringe 20. The twin-gripper 75 has upper and lower gripper assemblies 80 and 81 which both grip the first successive MD thread 24 as shedding means 33 release the MD thread 24 from the fringe 20. After gripping the MD thread 24, the pivoting twin-gripper body 75 pivots to the transfer position, adjacent to the fixed housing 72, in a plane parallel to the fringe 20, as shown in FIG. 2. The captured MD thread 24 is positively retained by the upper and lower gripper assemblies 80 and 81 as the twin-gripper 75 pivots to the transfer position.

A rotary drive system 60 is attached to the base 56 of the gripper-transfer arm assembly 50. The rotary drive 60, which is mounted at a fixed position above the join area on the seaming apparatus 1, rotates the gripper-transfer arm assembly 50 from the position shown in FIG. 2, parallel to the MD threads 24 in the fringe 20, to the interlacing position shown in FIG. 3. This carries the MD thread 24 to the plane of the shed opening in the auxiliary threads 16. The drive system 60 can be made by conventional means known to those skilled in the art.

Referring again to FIG. 3, the interlacing arm 40 extends through the shed opening 36 in the strip of auxiliary threads 16 from the opposite side of the auxiliary strip 16 from the gripper-transfer arm 50. The gripping means 41 on the free end of the interlacing arm 40 grips the MD thread 24 while it remains captured by the upper and lower grippers 80 and 81 on the twin-gripper body 75. The MD thread 24 is then released by the upper and lower gripper assemblies 80 and 81 on the gripper-transfer arm 50, and pulled through the shed opening 36 by the interlacing arm 40.

Figure 4:
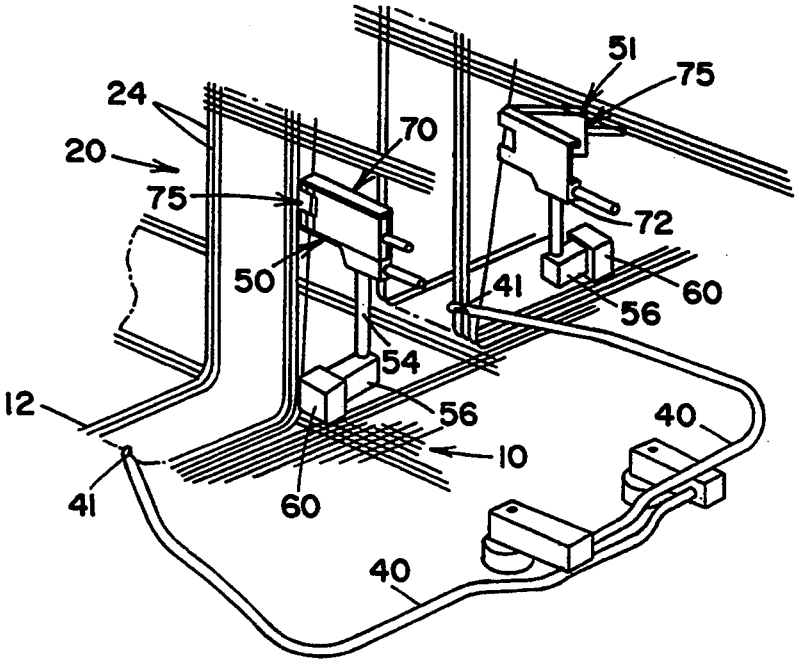
FIG. 4 shows the interlacing arm pulling the selected thread through the shed opening.
Figure 5:
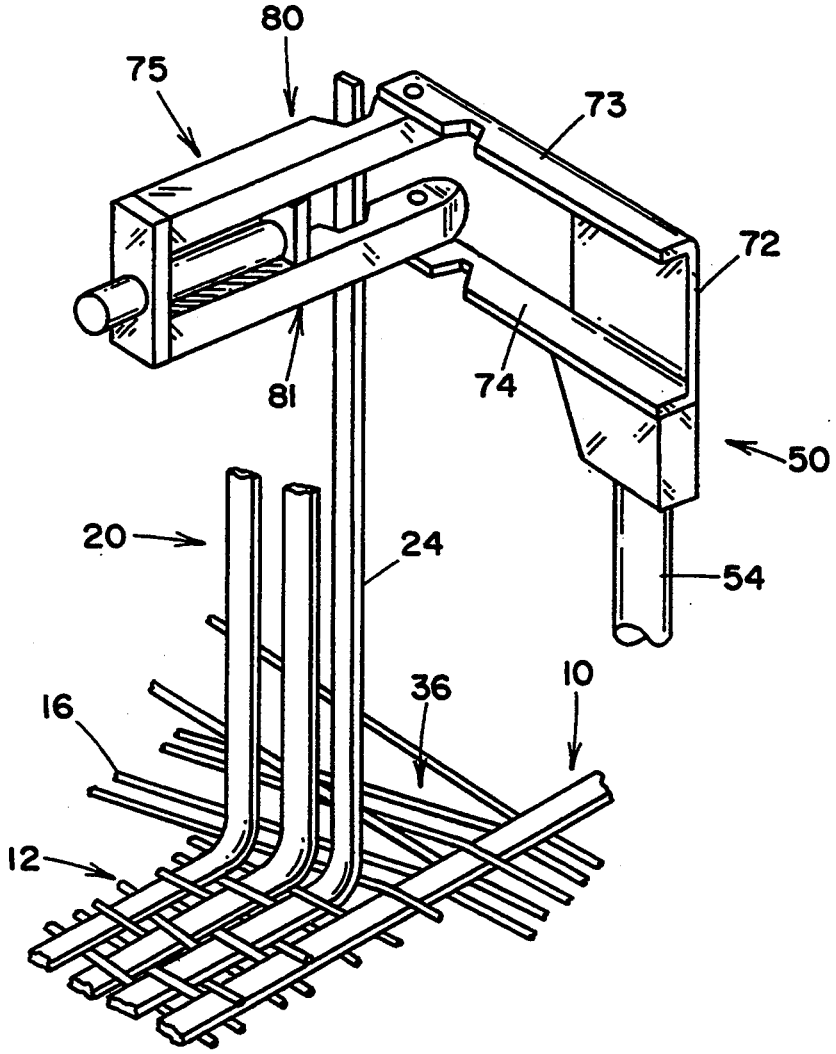
FIG. 5 is an enlarged perspective view of the gripper-transfer arm addressing a thread in the join area.

The gripper-transfer arm 50 then rotates back to the position shown in FIG. 4 as the sequence is repeated by the opposite gripper-transfer arm 51 acting on the opposite fringe 20 of the woven fabric 14. By sequentially repeating this process with MD threads 24 from the opposite ends 12 and 14 of the woven fabric, the seam or join 10 is formed.

Referring to FIGS. 5–8, a sequential series of enlarged perspective views of the seam area are shown. These sequential view illustrate the movement of the MD thread 24, shown with a rectangular cross-section for clarity, as it is manipulated from the fringe 20 by the gripper-transfer arm assembly 50 to the seam 10. FIGS. 5, 6, 7 and 8 are coordinated with FIGS. 1, 2, 3 and 4, respectively.

Figure 6:
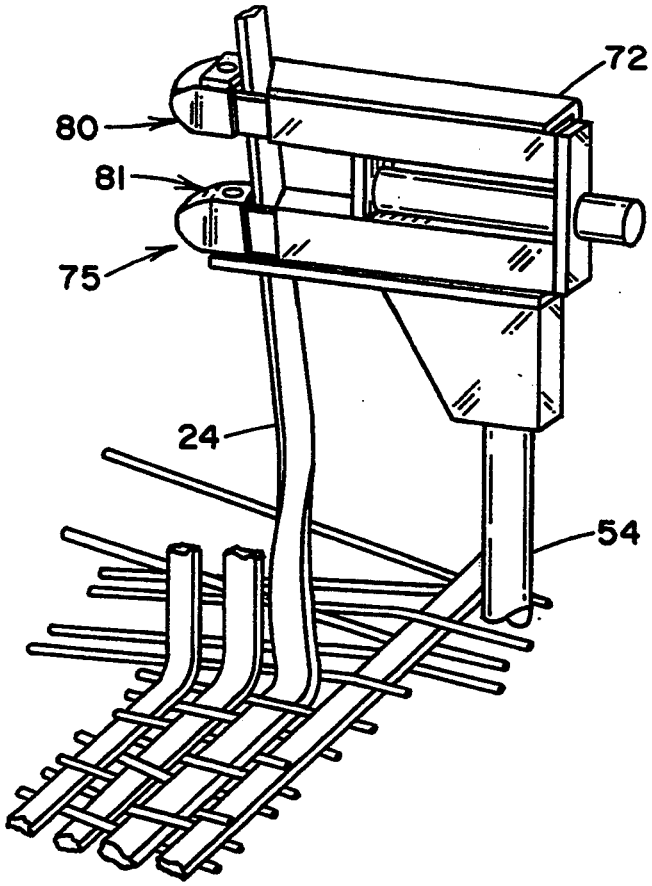
FIG. 6 shows the gripper-transfer arm of FIG. 5 twisting the captured thread.

Referring again to FIG. 5, the fringe portion of the fabric 12 is shown. The fringe portion MD threads 24 are retained in their original woven fabric orientation. The twin-gripper body 75 is shown in the initial, gripping position, pivoted out from the fixed housing 72, and generally normal to the fringe 20. The MD thread 24 is gripped in two positions and retained by upper and lower gripper assemblies 80 and 81 on the twin-gripper body 75. The twin-gripper body 75 pivots toward housing 72 to the transfer position, parallel to the fringe 20, twisting the captured MD thread 24 to the second orientation as shown in FIG. 6.

Figure 7:
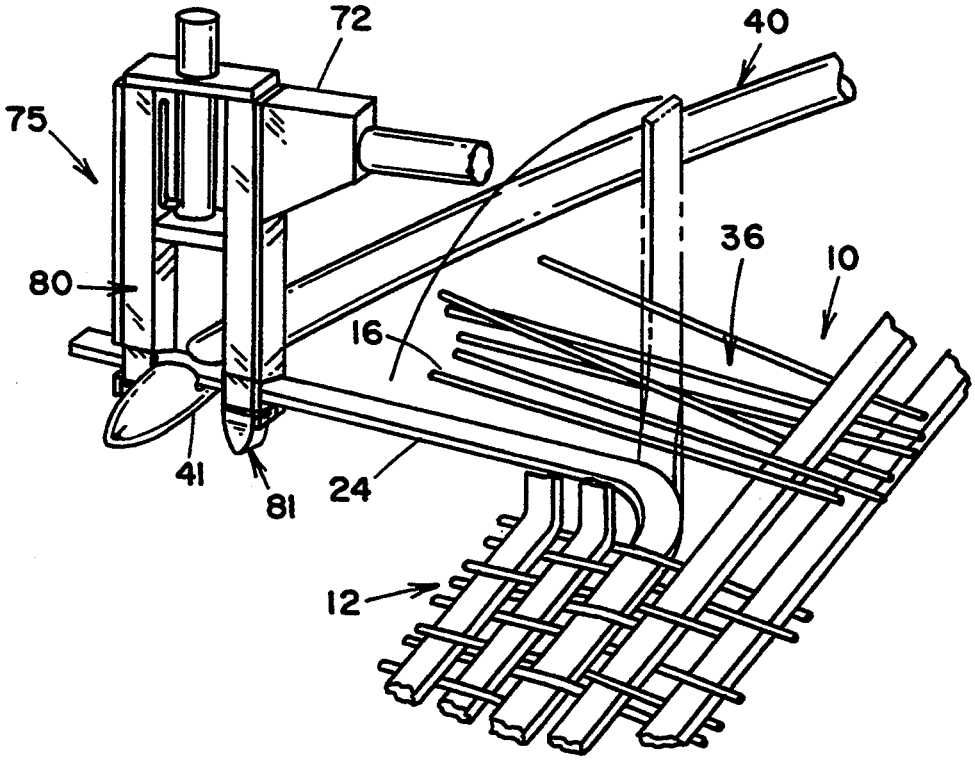
FIG. 7 shows the gripper-transfer arm transferring the thread from the fringe position to the shed opening.

The captured MD thread 24 is translated by the gripper-transfer arm 50 to the interlacing position in the plane of the auxiliary CMD thread 16 next to the shed opening 36, as shown in FIG. 7. The combination of positively retaining and translating the MD thread 24 reorients the thread 24 so that it is poised to return to its original woven fabric orientation as it is drawn through the shed 36.

Figure 8:
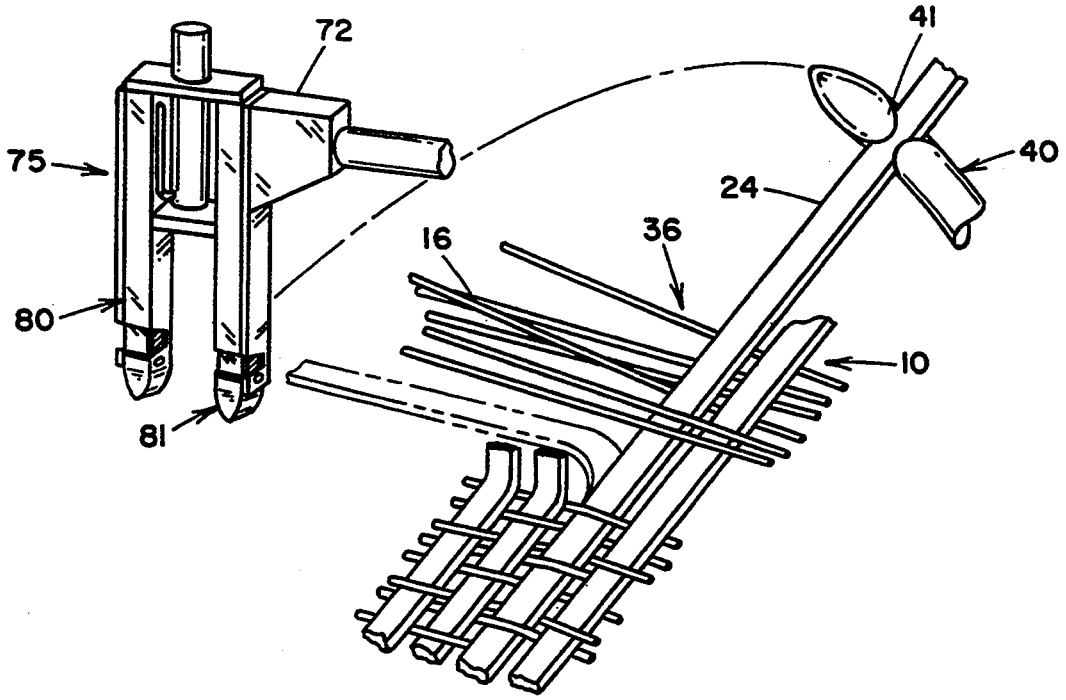
FIG. 8 shows the thread being released from the gripper-transfer arm and pulled through the shed opening.

The MD thread 24 is gripped by a gripper 41 on interlacing arm 40 between the upper and lower gripper assemblies 80 and 81 on the twin-gripper 75. It will be appreciated by those skilled in the art that the prior step of gripping the MD thread 24 between the upper and lower gripper assemblies 80 and 81 is instrumental in maintaining the MD thread 24 in its proper orientation as it is gripped by the interlacing arm 41. After being gripped by the interlacing arm 40, the MD thread 24 is released by both the upper and lower gripper assemblies 80 and 81. The interlacing arm 40 then pulls the MD thread 24 through the shed opening 36, as shown in FIG. 8. Utilizing the twin-gripper transfer arm assembly 50 in this manner insures that the MD thread is returned to its original woven fabric orientation as it is woven into the join 10.

Having described the operation of the gripper-transfer arm assembly 50, its structure will be described in more detail. While only the left hand gripper-transfer arm assembly 50 will be described, it will be recognized by those skilled in the art that the right hand gripper-transfer arm assembly 51 is an equivalent opposite-hand assembly.

Figure 9:
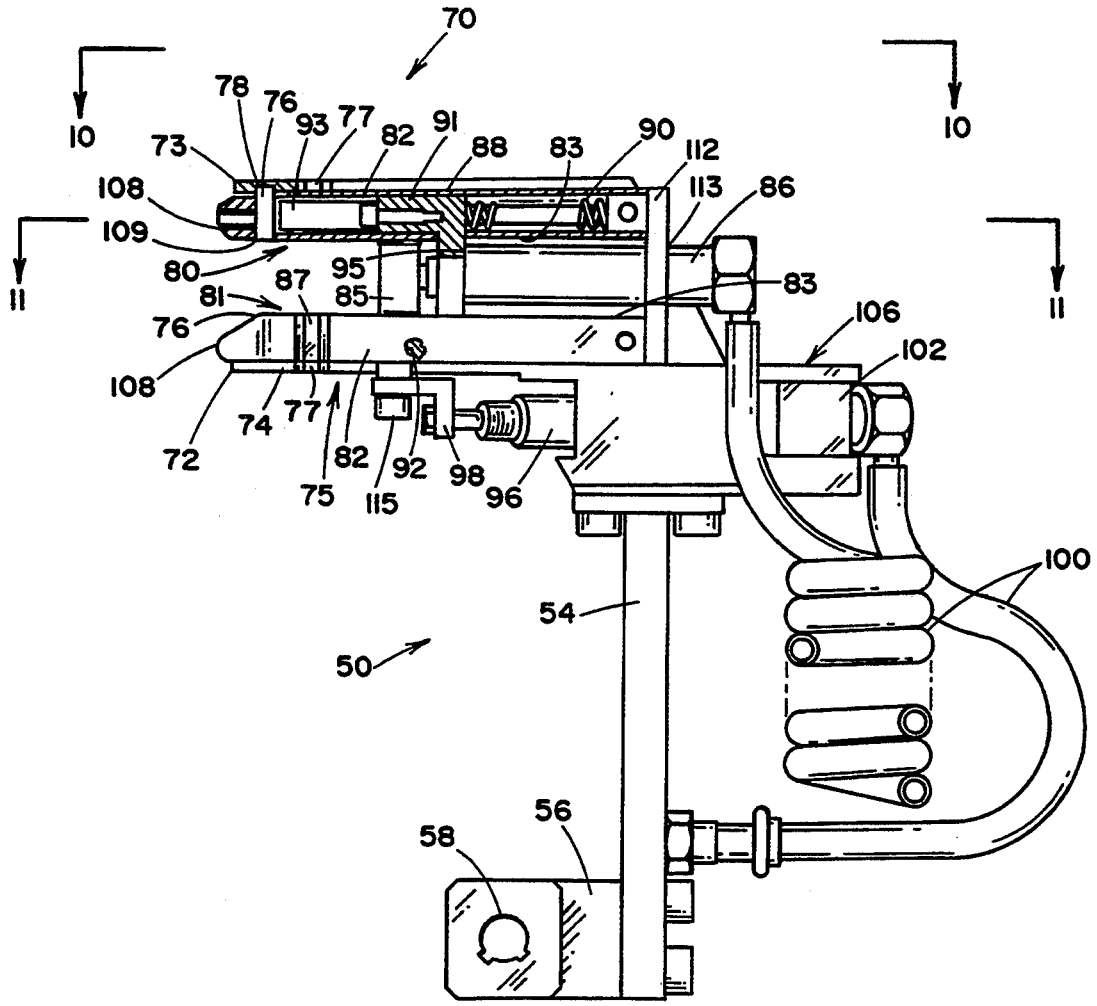
FIG. 9 is a side view of the gripper-transfer arm.
Figure 11:
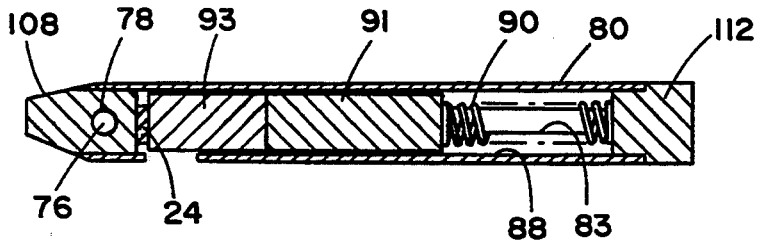
FIG. 11 is a view along 11—11 in FIG. 9.
Figure 10:
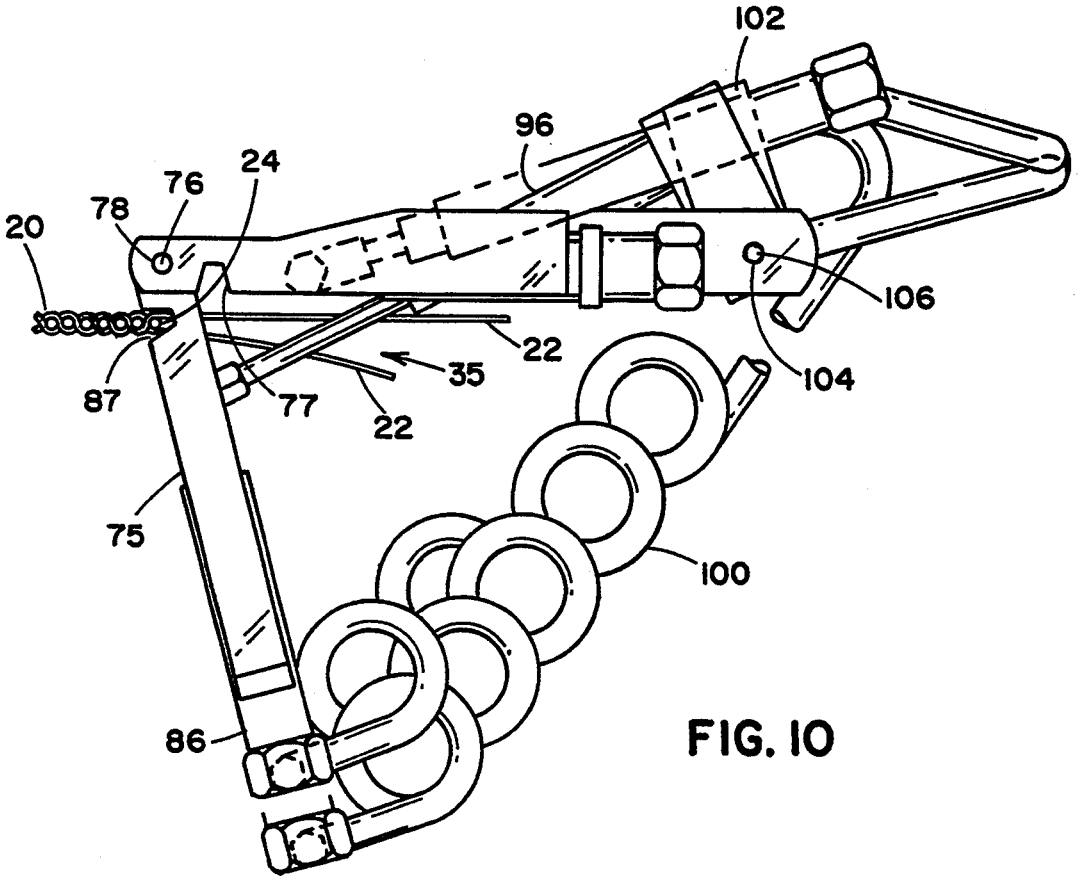
FIG. 10 is a view along 10—10 in FIG. 9.

FIGS. 9–11 provide detailed views of the gripper-transfer arm assembly 50. The gripper-transfer arm 50 is comprised of a twin-gripper assembly 70 which is attached to the base 56 by the arm 54, as previously described. The base has a keyed aperture 58 which is secured to a shaft from the drive system 60 (not shown). The pivoting gripper body 75 is mounted between a set of flat, parallel supports 73 and 74, shown more clearly in FIG. 5, which extend from the housing 72.

The gripper assemblies 80 and 81, which make up the pivoting twin-gripper body 75, are constructed from tubes 82, having square cross-sections, which are attached to and spaced apart by a cross-support 85. Each tube 82 is parallel and in close proximity to a respective support 73 and 74 on housing 72.

Tapered end pieces 108, are installed in the open ends of each tube 82. The ends of tubes 82 are configured to provide a smooth transition between each end piece 108 and the tube body. The tapered ends are required to insure that the twin-gripper body 75 can pass between the fringe 20 and the strip of auxiliary threads 16 to a position next to the shed opening 36 without catching or snagging the fringe 20 or CMD threads in the auxiliary strip 16.

Apertures 78 extend along a common center line through the ends of supports 73 and 74, the upper and lower tubes 82, and the respective end pieces 108. Pins 76 are disposed in the apertures 78 and extend through each support 73 or 74 and the respective upper or lower tube 82, forming the pivotal attachment between the twin-gripper body 75 and the fixed housing 72.

Upper and lower pistons 91 and 92, connected by cross member 95, are fitted into the bores 88 of the upper and lower tubes 82. The cross member 95 extends through opposing longitudinal slots 83 in the tubes 82. Springs 90 are installed in the upper and lower tubes 82 behind the pistons 91 and 92 to keep the pistons in the closed, rest position.

Actuator support 112 connects the free ends of the upper and lower tubes 82 and closes off the open tube ends after each pistons 91 and 92 and springs 90 have been installed. Air cylinder actuator 86 is slidably mounted through an aperture 113 in the support 112 and the stationary portion is attached to cross-support 85. The moveable portion of the actuator 86 is attached to cross-member 95.

Aligned cross slots 87 in the tubes 82 expose the grippers 93, affixed to the front of each piston 91 and 92. Grippers 93 are attached to the front of each piston 91 and 92. The grippers 93 can be replaced with grippers having different configurations depending on the thread configuration. In order to grip a flat thread, as shown in FIG. 11, the gripper 93 has a square end. This ensures that the thread is gripped and retained in its original woven fabric orientation.

Referring now to FIG. 10, slots 77 in the supports 73 and 74 are aligned with the slots 87 in the tubes 82, and provide clearance for the captured MD thread 24 as the pivoting twin-gripper body 75 swings from the initial, gripping position to the transfer position, as previously described.

Referring again to FIG. 9, a pivot post 115 is affixed to the lower gripper assembly 81 on the pivoting gripper body 75. A second air cylinder actuator 96 is attached by an arm 98 to the pivot post 115. The opposite end is attached to a support 102 on the fixed housing 72. The support 102 is pivotally attached to fixed housing 72 by a pin 106 extending through an aperture 104 in the housing 72 and the support 102. When actuated, the second air cylinder 96 swings the pivoting gripper body 75 about the pins 76 between the gripping and transfer positions.

Having described the structure of the gripper-transfer arm 50 in detail, a detailed description of its operation will be given with reference to FIGS. 10 and 11. The slots 87 on the twin-gripper assemblies 80 and 81 approach the first MD thread 24 as the pivoting gripper body 75 is moved by actuator 96 to the initial, gripping position. The grippers 93 on pistons 91 and 92 are retracted by actuator 86 acting on cross member 95. As the pistons 91 and 92 are retracted, the springs 90 are compressed. When the first MD thread 24, maintained in its original fabric orientation, is released from the fringe 20, the actuator 86 is disengaged. The stored energy in the springs 90 return the grippers 93 to the closed, gripping position. Each gripper 93 secures the MD thread 24, retaining it in its original orientation. The actuator 96 then retracts the pivoting twin-gripper body 75 to the transfer position, nested between the supports 73 and 74 of the housing 72. This movement pulls the captured MD thread 24 from the fringe 20 and twists it to a second orientation as previously described and illustrated in FIGS. 5 and 6. After the gripper-transfer arm 50 translates the MD thread 24 to the interlacing position, parallel to the shed opening 36, the gripper 41 on the interlacing arm 40 grips the MD thread 24 between the upper and lower gripper assemblies 80 and 81. The actuator 86 then retracts pistons 91 and 92, releasing the MD thread 24 from the grippers 93.

Figure 13:
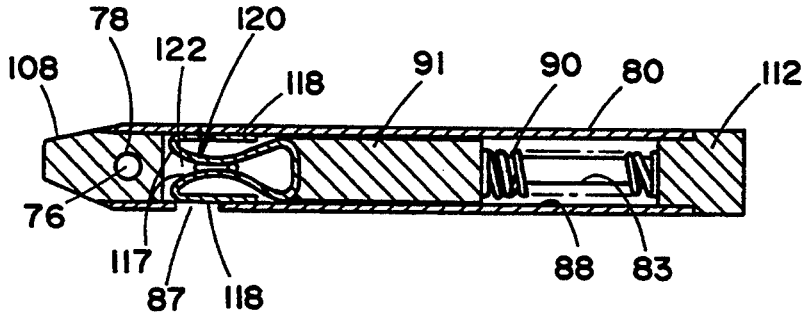
FIG. 13 is a view along 13—13 in FIG. 12.
Figure 12:
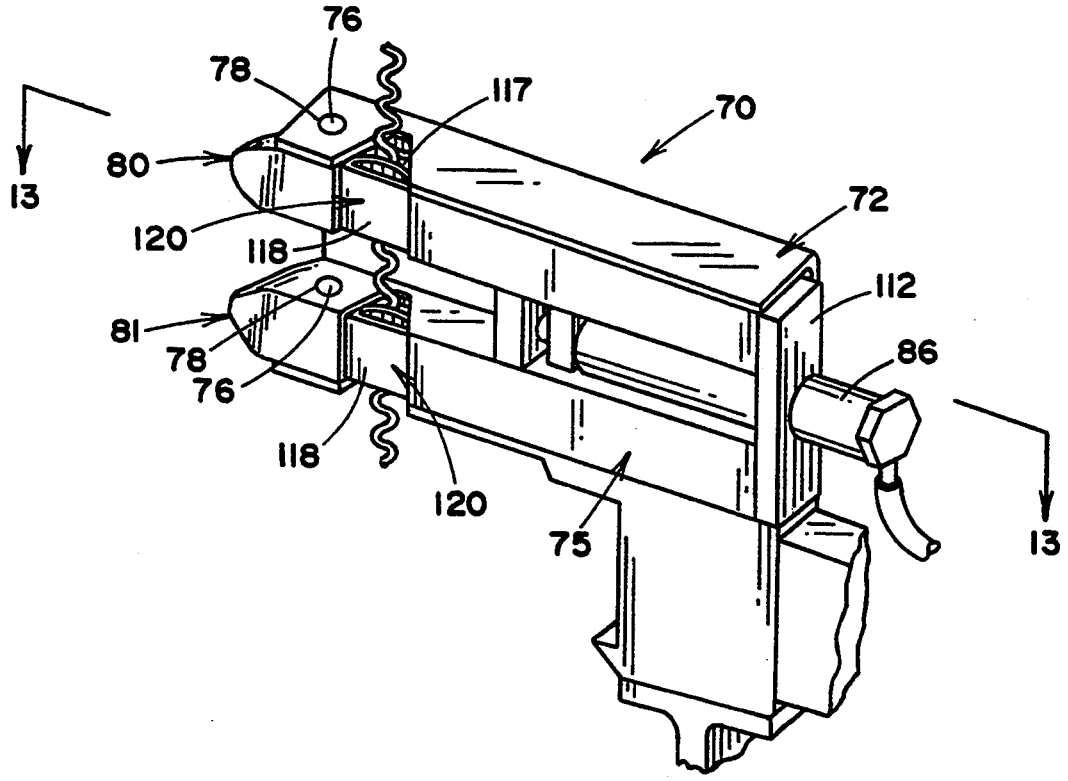
FIG. 12 is a perspective view of an alternate embodiment of the gripper.

Referring to FIGS. 12 and 13, an alternate embodiment of the gripper 120 is shown affixed to the front of each piston 91 and 92. This embodiment can be used for round cross section yarns which are crimped or deformed, as illustrated in FIG. 12. The gripper 120 is formed from flat spring steel and is sized for close conforming fit with the bore 88 of each tube 82. The opening 122 formed between arms 117 lies in the same direction as the stroke of pistons 91 and 92, allowing the gripper to secure deformed round yarns as shown. One side 118 on the gripper 120 closes off each slot 87 when the grippers are in the closed, rest position.

Although the preferred embodiment of the yarn positioning apparatus has been described in the context of the gripper-transfer arm assembly 50 for use in an automatic seaming machine 1, it will be recognized by those skilled in the art that the yarn positioning apparatus can be used in other applications.

We claim:

1. An improved seaming apparatus for forming a woven join between opposite ends of a length of woven fabric, formed from interwoven machine direction (MD) and cross machine direction (CMD) threads, of the type in which an auxiliary strip of threads is supported in parallel relation to the CMD threads in the woven fabric, and opposite ends of the fabric are supported on opposite sides of the auxiliary threads, each end of the woven fabric includes a fringe of (MD) threads which are successively separated from the fringe and interwoven with the auxiliary threads to thereby form the join, wherein the improvement comprises:

an apparatus for translating yarns in the proper position and orientation for weaving including means for gripping a thread from the fringe in a first orientation;

means for repositioning the thread to a second orientation; and means for retaining the thread in the second orientation as it is translated to the weaving position.

2. The apparatus of claim 1 wherein said first orientation is the original woven fabric orientation.

3. The apparatus of claim 1 wherein the gripping means and retaining means are combined.

4. An improved seaming apparatus for forming a woven join between opposite ends of a length of woven fabric, formed from interwoven machine (MD) and cross machine direction (CMD) threads, of the type in which an auxiliary strip of threads is supported in parallel relation to the CMD threads in the woven fabric, and opposite ends of the fabric are supported on opposite sides of the auxiliary threads, each end of the woven fabric includes a fringe of MD threads which are successively separated from the fringe and interwoven with the auxiliary threads to thereby form the join, wherein the improvement comprises:

means for gripping a successive MD thread from the fringe in its woven orientation and twisting it to a second orientation; and, means for retaining the successive MD thread in its second orientation as it is translated to a position parallel to the auxiliary threads, such that it is interwoven with the auxiliary threads in its original woven orientation.

5. A method for forming a join in a length of woven fabric, formed from interwoven machine direction (MD) and cross machine direction (CMD) threads, having opposite ends to join together to thereby form an endless woven fabric belt, the method comprising the steps of:

providing an auxiliary strip of threads and a means for supporting them in parallel relation to the CMD threads in the woven fabric;

providing a means for forming a shed opening in the auxiliary threads;

providing a means for supporting a fringe of MD threads on opposite ends of the fabric on opposite sides of the auxiliary threads;

providing means for gripping successive MD threads, for twisting the gripped MD threads to a second orientation and for translating the MD threads to the shed opening while retaining them in their second orientation;

providing a means for gripping and pulling the successive MD threads through the shed opening to form the seam;

releasing a successive MD thread from the fringe;

gripping the successive MD thread in its woven orientation;

twisting the successive MD thread to a second orientation;

forming a shed opening in the auxiliary strip of CMD threads;

translating the successive MD thread to the shed opening;

gripping the successive MD thread by said means for pulling the successive MD thread through the shed opening;

releasing the MD thread from the gripping, twisting and translating means;

pulling the successive MD thread through the shed opening so that it is interwoven with the auxiliary strip of CMD threads in its original woven fabric orientation.

* * * * *